US006789004B2

(12) United States Patent
Brousseau et al.

(10) Patent No.: US 6,789,004 B2
(45) **Date of Patent: *Sep. 7, 2004**

(54) REMOTE CONTROL SYSTEM FOR LOCOMOTIVES

(75) Inventors: André Brousseau, Chateauguay (CA); Oleh Szklar, St-Hubert (CA); Luc Ethier, St-Eustache (CA); Folkert Horst, Pierrefonds (CA)

(73) Assignee: Beltpack Corporation, Montreal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/201,427

(22) Filed: Jul. 22, 2002

(65) Prior Publication Data

US 2003/0040853 A1 Feb. 27, 2003

Related U.S. Application Data

(63) Continuation of application No. 10/041,797, filed on Jan. 7, 2002, now Pat. No. 6,449,536, which is a continuation of application No. 09/616,115, filed on Jul. 14, 2000, now abandoned.

(51) Int. Cl.[7] ..... H04B 1/00; B06Q 1/00; B60T 13/68

(52) U.S. Cl. ..... 701/19; 701/20; 340/538

(58) Field of Search ..... 701/19, 20, 70; 105/61, 26.05; 340/825.52, 5.61, 5.8, 538, 870.11, 825.72; 246/167 R, 182 R, 187 C, 187 A, 182 A

(56) References Cited

U.S. PATENT DOCUMENTS

| | | | | |
|---|---|---|---|---|
| 3,096,056 A | * | 7/1963 | Allison | 246/187 |
| 3,639,755 A | | 2/1972 | Wrege | 246/187 B |
| 4,401,035 A | | 8/1983 | Spigarelli et al. | 105/61 |

(List continued on next page.)

FOREIGN PATENT DOCUMENTS

| | | |
|---|---|---|
| EP | 0704590 | 4/1996 |
| WO | WO 00/58142 | 10/2000 |

OTHER PUBLICATIONS

Steve Hennessy "Locotrol Distributed Power, New Application, Kansas City Southern" Mar. 30, 2000.

Steve Hennessy "GE Harris Railway Electronics, 2000 International User Conference, Train Control Technology, New Perspectives for the new Millennium, Locotrol Distributed Power" Mar. 29–31, 2000.

*Primary Examiner*—Tan Q. Nguyen
*Assistant Examiner*—Dalena Tran
(74) *Attorney, Agent, or Firm*—Merchant & Gould, P.C.

(57) ABSTRACT

A system of controller modules allowing to remotely control a train having a first locomotive and a second locomotive separated from one another by at least one car is provided. The system of controller modules comprises a first controller module associated to the first locomotive and a second controller module associated to the second locomotive. One of said controller modules has a lead operational status and the other has a trail operational status. The controller module having the lead operational status receives a master control signal for signaling the train to move in a desired direction and releases in response to the master control signal a first local command signal. The first local command signal is operative to cause displacement of the locomotive associated with the controller module having the lead operational status. The controller module having a lead operational status is further operative to transmit to the controller module having a trail operational status a local control signal derived from the master control signal. The controller module having the trail operational status is responsive to the local control signal to generate a second command signal operative to cause displacement of the locomotive associated to the controller module having a trail operational status. The movement of the locomotive associated with the controller module having the lead operational status and the movement of the locomotive associated with the controller module having the trail operational status is such as to cause displacement of the train in the desired direction.

61 Claims, 6 Drawing Sheets

U.S. PATENT DOCUMENTS 4,582,280 A 4/1986 Nichols et al. ..... 246/182 R
4,652,057 A * 3/1987 Engle et al. ..... 303/3
4,687,258 A 8/1987 Astley ..... 303/3
4,702,291 A 10/1987 Engle ..... 105/35
4,830,437 A 5/1989 Rumsey ..... 303/18
5,039,038 A 8/1991 Nichols et al. ..... 246/3
5,332,297 A 7/1994 Cuckelman et al. ..... 303/15
5,495,520 A 2/1996 Kojima ..... 455/411
5,570,284 A 10/1996 Roselli et al. ..... 701/2
5,685,507 A 11/1997 Horst et al. ..... 246/187 A
5,691,980 A 11/1997 Welles, II et al. ..... 370/316
5,697,583 A * 12/1997 Kane ..... 246/187 C
5,718,487 A 2/1998 Roselli et al. ..... 303/14
5,777,547 A * 7/1998 Waldrop ..... 340/438
5,884,146 A 3/1999 Simmons ..... 455/66
5,986,579 A 11/1999 Halvorson ..... 340/933
6,175,784 B1 1/2001 Jicha et al. ..... 701/19
6,314,345 B1 * 11/2001 Coombes ..... 701/19
6,322,025 B1 * 11/2001 Colbert et al. ..... 246/167 R

* cited by examiner

REMOTE CONTROL SYSTEM FOR LOCOMOTIVES

CROSS-REFERENCE TO RELATED APPLICATIONS

This application is a continuation of U.S. patent application Ser. No. 10/041,797 filed Jan. 7, 2002 now U.S. Pat. No. 6,449,536 which was a continuation of patent application serial U.S. patent application Ser. No. 09/616,115 filed Jul. 14, 2000 now abandoned.

FIELD OF THE INVENTION

The present invention relates to an electronic system for remotely controlling locomotives in a train. The system is particularly suitable for use in transfer assignments as well as switching yard assignments.

BACKGROUND OF THE INVENTION

Economic constraints have led railway companies to develop portable units allowing a ground-based operator to remotely control a locomotive in a switching yard. The module is essentially a transmitter communicating with a trail controller on the locomotive by way of a radio link. Typically, the operator carries this module and can perform duties such as coupling, and uncoupling cars while remaining in control of the locomotive movement at all times. This allows for placing the point of control at the point of movement thereby potentially enhancing safety, accuracy and efficiency.

Remote locomotive controllers currently used in the industry are relatively simple devices that enable the operator to manually regulate the throttle and brake in order to accelerate, decelerate and/or maintain a desired speed. The operator is required to judge the speed of the locomotive and modulate the throttle and/or brake levers to control the movement of the locomotive. Therefore, the operator must possess a good understanding of the track dynamics, the braking characteristics of the train, etc. to remotely operate the locomotive in a safe manner.

In several situations where locomotives and trains are used, there are both forward and backward movements of the train. In certain circumstances, the locomotive is pulling the train. In instances where the train is going in the opposite direction, the locomotive is pushing the train. In these situations, the remote locomotive controllers also enable the operator to manually regulate the direction of movement of the locomotive. Regulations define a limited distance during which the locomotive may push the train given that, during the time that the locomotive is pushing the train, there is no conductor at the front end of the train. A common solution to this problem is to have a caboose at the other end of the train where another conductor stands and observes where the train is going. Such a solution requires a duplication of the amount of personnel that is required to operate a train, thereby incurring additional costs in the form of an extra crew person. However, these extra crewmembers are required for security purposes.

Accordingly, there exists a need in the industry to provide a system for remotely controlling a locomotive that alleviates at least some of the problems associated with prior art devices.

SUMMARY OF THE INVENTION

In accordance with a broad aspect, the present invention provides a system of controller modules allowing to remotely control a train having a first locomotive and a second locomotive separated from one another by at least one car. The system of controller modules comprises a first controller module associated to the first locomotive and a second controller module associated to the second locomotive. One of the controller modules has a lead operational status and the other of the controller modules has a trail operational status. The controller module having the lead operational status includes an input for receiving a master control signal for signaling the train to move in a desired direction. The controller module having the lead operational status also includes an output to release in response to the master control signal a first local command signal operative to cause displacement of the locomotive associated with the controller module having the lead operational status. The controller module having the trail operational status includes an output. The controller module having a lead operational status is further operative to transmit to the controller module having a trail operational status a local control signal derived from the master control signal. The controller module having the trail operational status is responsive to the local control signal to generate a second command signal operative to cause displacement of the locomotive associated to the controller module having a trail operational status. The movement of the locomotive associated with the controller module having the lead operational status and the movement of the locomotive associated with the controller module having the trail operational status being such as to cause displacement of the train in the desired direction.

In a specific example of implementation, the first controller module is operative to acquire either one of a lead operational status and a trail operational status and the second controller module is operative to acquire either one of a lead operational status and a trail operational status. When one of said controller modules acquires the lead operational status the other of the controller modules acquires the trail operational status.

In a specific non-limiting example of implementation, the master control signal is an RF (a radio frequency) signal issued from a remote module. The master control signal carries information about the direction in which the train is to move and also information about the desired throttle and/or speed of the train.

The controller module having the lead operational status includes at the input a receiver unit that senses the master control signal, demodulates the master control signal to extract the information relating to the direction of movement and throttle, brake and/or speed of the train and passes this information to a processing unit. The processing unit generates the first local command signal that conveys a throttle setting information and a brake setting information. The first local command signal is applied to the locomotive associated to the controller module having the lead operational status such as to set the throttle at the desired setting and the brake at the desired setting in order to achieve the desired speed in the desired direction.

The processing unit also generates throttle setting information and brake setting information for the locomotive associated with the controller module having the trail operational status. Typically, the throttle setting information for the second locomotive is such as to produce a displacement of the locomotive associated to the controller module having the trail operational status having the same velocity and direction as the displacement of the locomotive associated with the controller module having the lead operational status. As for the brake setting information, it is essentially identical to the brake setting information for the first locomotive.

Alternatively, other control strategies may be implemented. For instance, differences are introduced between the throttle setting information and the brake setting information computed for the locomotive associated to the controller module having the lead operational status and the throttle setting information and the brake setting information computed for the locomotive associated to the controller module having the trail operational status. This may be desirable to better control the movement of the train and reduce train action for example. A specific example is a situation where the track dynamics, train length and/or weight may be such that a totally synchronized movement between the two locomotives is not desired.

The controller module having the lead operational status sends to the controller module having the trail operational status over an RF link, a local control signal that contains the throttle setting information and the brake setting information for the locomotive associated to the controller module having the trail operational status. The controller module having the trail operational status includes an input coupled to the receiver unit to establish the RF link with the controller module having the lead operational status. The receiver unit demodulates the local control signal and passes the extracted information to a processing unit that generates the second command signal for application to the locomotive associated with the controller module having the trail operational status such as to set the throttle and the brake of that locomotive.

It will be noted that under this specific non-limiting example of implementation, the receiver unit of the controller module having the lead operational status is used to communicate with the remote module (for receiving the master control signal) and also to establish the RF link with the controller module having the trail operational status. Accordingly, the receiver unit can communicate over at least two (and possibly more) separate communication links.

In the specific non-limiting example of implementation described above, the controller modules are operative to switch roles, in other words the lead operational status can be transferred from the first controller module to the second controller module. This is desirable in circumstances where the direction of movement of the train is changed. In particular, an advantageous practice is to assign the lead operational status to the locomotive that is pulling the train. Accordingly, when the controller module that currently holds the lead operational status receives a master control signal which indicates to relinquish its lead operational status, the controller module that currently holds the lead operational status relinquishes the lead operational status to the other controller module and acquires the trail operational status. The exchange of status is effected by an exchange of commands over the RF link between the two controller modules.

In a specific example, when the first controller module has the lead operational status and the second controller module has the trail operational status, the first controller module is operative to relinquish the lead operational status and acquire the trail operational status. Similarly, the second controller module is operative to relinquish the trail operational status and to acquire the lead operational status. When the second controller module acquires the lead operational status and when the first controller module acquires the trail operational status, the second controller module is operative to receive the master control signal and is operative to transmit to the first controller module a local control signal derived from the master control signal.

In accordance with another broad aspect, the invention provides a system for remotely controlling a train having a first locomotive and a second locomotive separated from one another by at least one car. The system comprises a first controller module associated to the first locomotive, a second controller module associated to the second locomotive and a remote control module. Each of the modules has a machine readable storage medium for storage of an identifier, the identifier allowing to uniquely distinguish the modules from one another. Each module is operative to transmit messages to another one of the modules over a non-proximity communication link. A message sent by any one of the modules over the non-proximity communication link is sensed by each of the other modules. Each message includes an address portion for holding the identifier of the module to which the message is directed. Each message may also include an identifier associated to the module from which the message was sent. The remote control module and the first controller module are operative to establish a first proximity data exchange transaction. During the first proximity data exchange transaction, the remote control module acquires and stores in the machine readable storage medium of the remote control module the identifier of the first controller module. Similarly, the first controller module acquires and stores in the machine readable storage medium of the first controller module the identifier of the remote control module. The first proximity data exchange transaction excludes the second controller module.

The remote control module and the second controller module are operative to establish a second proximity data exchange transaction. During the second proximity data exchange transaction, the remote control module acquires and stores in the machine readable storage medium of the remote control module the identifier of the second controller module. Similarly, the second controller module acquires and stores in the machine readable storage medium of the second controller module the identifier of the remote control module and the identifier of the first controller module. The second proximity data exchange transaction excludes the first controller module.

The first controller module and the second controller module are operative to establish a third data exchange transaction over the non-proximity communication link such that the first controller module acquires and stores in the machine readable storage medium of the first controller module the identifier of the second controller module.

In a specific example of implementation, the first controller module is operative to acquire either one of a lead operational status and a trail operational status and the second controller module is operative to acquire either one of a lead operational status and a trail operational status. When one of said controller modules acquires the lead operational status, the other of the controller modules acquires the trail operational status.

The remote control module generates a master control signal for signaling the train to move in a desired direction. The controller module having the lead operational status includes an input for receiving the master control signal and an output to generate in response to the master control signal a first local command signal operative to cause displacement of the locomotive with which it is associated. The controller module having the lead operational status is further operative to transmit to the controller module having the trail operational status a local control signal derived from the master control signal. The controller module having the trail operational status has an output and it is responsive to the local control signal to generate a second command signal operative to cause displacement of the second locomotive such as to cause displacement of the train in the desired direction.

In a specific example of implementation, the non-proximity communication link is a radio frequency (RF) link, the first and second proximity data exchange transactions are effected over respective infra red (IR) links. Alternatively, first and second proximity data exchange transactions are effected over links selected from the set consisting of an infra red link, a coaxial cable link, a wire link and an optical cable link.

For the purposes of this specification, the expression "proximity data exchange transaction" is used to designate a transaction over a communication link where the participants of the transaction receive the messages that are transmitted over the communication link. Examples of such communication links include an infra red link, a coaxial cable link, a wire link and an optical cable link.

For the purposes of this specification, the expression "non-proximity communication link" is used to designate a transaction over a communication link where components other that the participants of the transaction receive the messages that are transmitted over the communication link. Examples of such communication links include radio frequency links.

DETAILED DESCRIPTION

Figure 1:
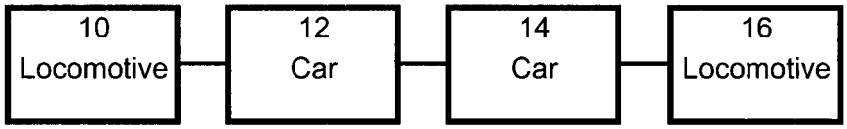
FIG. 1 is a very general illustration of a train that includes two locomotives separated by two cars.

FIG. 1 illustrates schematically a train configuration of the type that could be used advantageously in connection with an embodiment of the invention. The train configuration includes from left to right a first locomotive 10, a first car 12, a second car 14 and a second locomotive 16. For the purposes of the present invention a number of variations of the train configuration shown in FIG. 1 can be considered. For example it is not essential that the locomotives 10, 16 be located at the respective ends of the train. Possibilities where the ends of the train are formed by cars instead of locomotives are within the ambit of this invention. Also, it is not essential that the locomotives 10, 16 be separated by two cars. It can be envisaged to place between the locomotives 10, 16 more or less than two cars without departing from the spirit of the invention.

Under one possible form of implementation, the present invention provides a novel remote control system for the train configuration illustrated in FIG. 1. The remote control system includes three main components namely a remote control module and two controller modules. The remote control module is the device with which the operator conveys commands to the train. In a specific example of implementation, the remote control module includes a transmitter unit operative to send signals. Alternatively, the remote control module includes a transceiver unit operative to send and receive signals. The controller modules are mounted in the respective locomotives 10, 16 and they interface with existing throttle/brake actuators and other controls and sensors on the locomotive such as to control the locomotive in response to commands issued by the remote control module.

The physical layout of the remote control module is not illustrated in the drawings because it can greatly vary without departing from the spirit of the invention. The remote control module can be in the form of a portable module comprising a housing that encloses the electronic circuitry and a battery supplying electrical power to operate the remote control module. A plurality of manually operable levers and switches project outside the housing and are provided to dial-in train speed, brake and other possible settings. For additional specific information on this topic and for general information on remote locomotive control systems the reader is invited to consult the U.S. Pat. Nos. 5,511,749 and 5,685,507 granted to CANAC International Inc. and the U.S. Pat. No. 4,582,280 assigned to the Harris Corp. The contents of these documents are incorporated herein by reference. Alternatively, the remote control module can be in the form of a console fixed in either one of the locomotives 10, 16.

Figure 3:
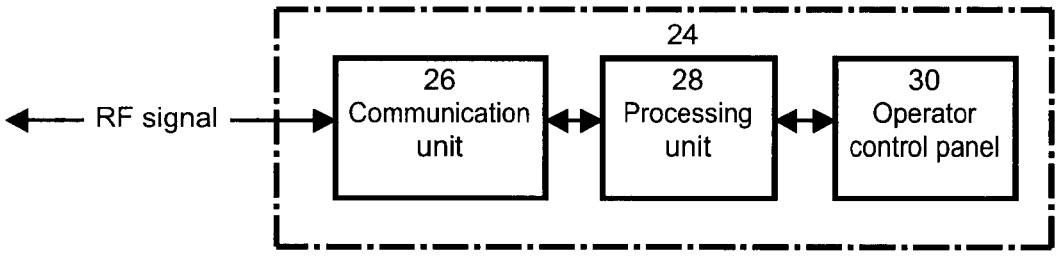
FIG. 3 is a functional block diagram of the remote control module of the remote control system for a locomotive in accordance with a non-limiting example of implementation of the present invention.

FIG. 3 provides a functional block diagram of the remote control module that is designated by the reference numeral 24. The remote control module 24 includes three main units or blocks namely, the operator control panel 30, a processing unit 28 and a communication unit 26. As briefly mentioned above, the operator control panel 30 encompasses the various manually operable levers and switches designed to be selectively actuated by the operator in order to dial-in train speed, throttle, brake and other possible settings. The operator control panel 30 generates electrical signals that are directed to the processing unit 28. The structure of the processing unit 28 will be described in greater detail later in this specification. For the moment, suffice it to say that the processing unit 28 receives the raw electrical signals from the operator control panel 30 and generates a digital train status word that reflects the desired functional status of the train. In other words, the digital train status expresses in what direction the train should be moving, at what speed, whether the headlights on the locomotive should be on, whether the horn should be activated, etc. Optionally, the digital train status may express what throttle/brake should be applied instead of or in addition to a desired speed indicator. The digital train status word is part of a packet of bits arranged according to a certain format. Various possible formats can be considered without departing from the spirit of the invention. In one specific example, the format includes a header portion, a user data portion and an error detection/correction portion. The header portion includes an address that uniquely identifies the controller module to whom the packet is destined. The user data portion includes the digital train status word data. Finally the error detection/correction portion includes data allowing to detect and possibly correct transmission errors. Optionally, the error detection/correction includes a data element indicative of the address of the sender. Examples of error detection/correction strategies include data parity, cyclic redundancy check (CRC), check sum, among other possibilities.

The packet of bits generated by the processing unit 28 is passed to the communication unit 26 that includes a transmitter unit. The transmitter unit handles outgoing signals. Optionally, the communication unit 26 includes a receiver unit handling incoming signals. The transmitter unit modulates the packet to produce an RF signal. Frequency shift keying (FSK) is a suitable modulation technique. The RF signal transmitted by the remote control module 24 forms a master control signal.

Figure 2:
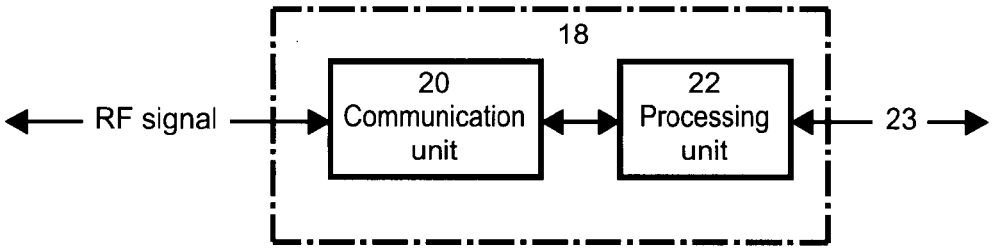
FIG. 2 is a functional block diagram of a controller module of the remote control system for a locomotive in accordance with a non-limiting example of implementation of the present invention.

The RF master control signal issued by the remote control module 24 is received by a controller module 18 illustrated in FIG. 2. The remote control system includes two controller modules 18, one mounted on each locomotive 10, 16. Under the example of implementation described here the controller modules 18 are identical, accordingly, only one will be described with the understanding that the structure and operation of the other controller module 18 are identical.

Figure 4:
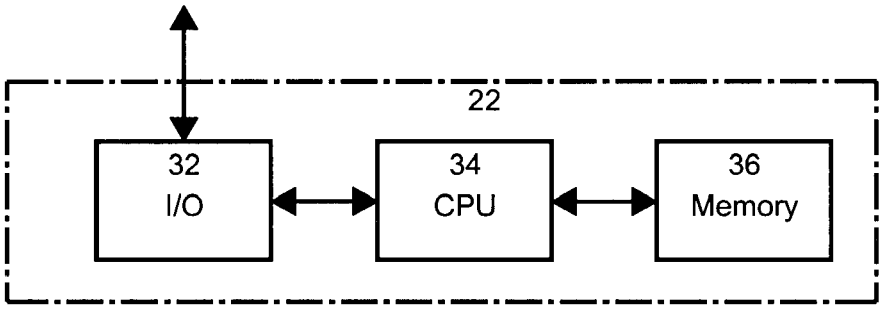
FIG. 4 is a block diagram of the processing unit of the controller module illustrated in FIG. 2.

The controller module 18 includes a communication unit 20 that in general is very similar to the communication unit 26 described earlier. In particular, the communication unit 20 includes a transmitter unit and a receiver unit. The controller module 18 also includes a processing unit 22 that is linked to the communication unit 20. The function of the receiver unit of the communication unit 20 is to demodulate the RF master control signal and to extract header information and the train status word data that are passed to the processing unit 22. The structure of the processing unit 22 is illustrated in FIG. 4. Generally stated, the processing unit 22 is a computing device including a central processing unit (CPU) 34 that is connected through a data bus with a memory 36. Typically, the memory 36 will comprise a non-volatile portion designed to retain data without loss even when the electrical power is discontinued. The memory 36 also includes a random access memory portion divided into two segments one for holding the instructions of the program element that are executed by the CPU 34 and another one for holding data on which the program element executed by the CPU 34 operates. The processing unit 22 also includes an input/output (I/O) interface 32 of a conventional construction that allows the processing unit 22 to exchange signals with the external world.

It should be noted that the structure of the processing unit 28 is very similar to the structure of the processing unit 22 as described in connection with FIG. 4.

The controller module 18 includes an input/output 23 that is used for exchanging signals with the locomotive in which the controller module 18 is installed. In particular, the input/output 23 is the port through which the controller module 18 issues a local command signal to cause the locomotive to move in a certain direction and at a certain speed. More specifically, the local command signal includes a throttle setting information, direction of travel, brake setting information etc. Also, the controller module 18 receives through the input/output 23 signals from sensors in the locomotive that provide real-time information on the actual speed, direction of movement and alarms. The processing unit 22 receives the signals from the locomotive and interprets them by using a suitable algorithm in order to adjust the local command signal such as to maintain the direction of travel and speed or throttle/brake setting specified in the master control signal from the remote control module 24. The person skilled in the art will readily appreciate that the controller module 18 may include additional input/output ports for receiving a master control signal without detracting from the spirit of the invention.

Most locomotive manufacturers will install on the diesel/electric engine as original equipment a series of actuators that control the fuel injection, power contacts and brakes among others, hence the tractive power that the locomotive develops. This feature permits coupling several locomotives under the control of one driver. By electrically and pneumatically interconnecting the actuators of all the locomotives, the throttle commands the driver issues in the cab of the lead engine are duplicated in all the trail locomotives. The locomotive remote control system in accordance with the invention makes use of the existing throttle/brake actuators in order to control power. This feature is described in greater detail in the U.S. Pat. No. 5,685,507 mentioned earlier in this specification.

Figure 5A:
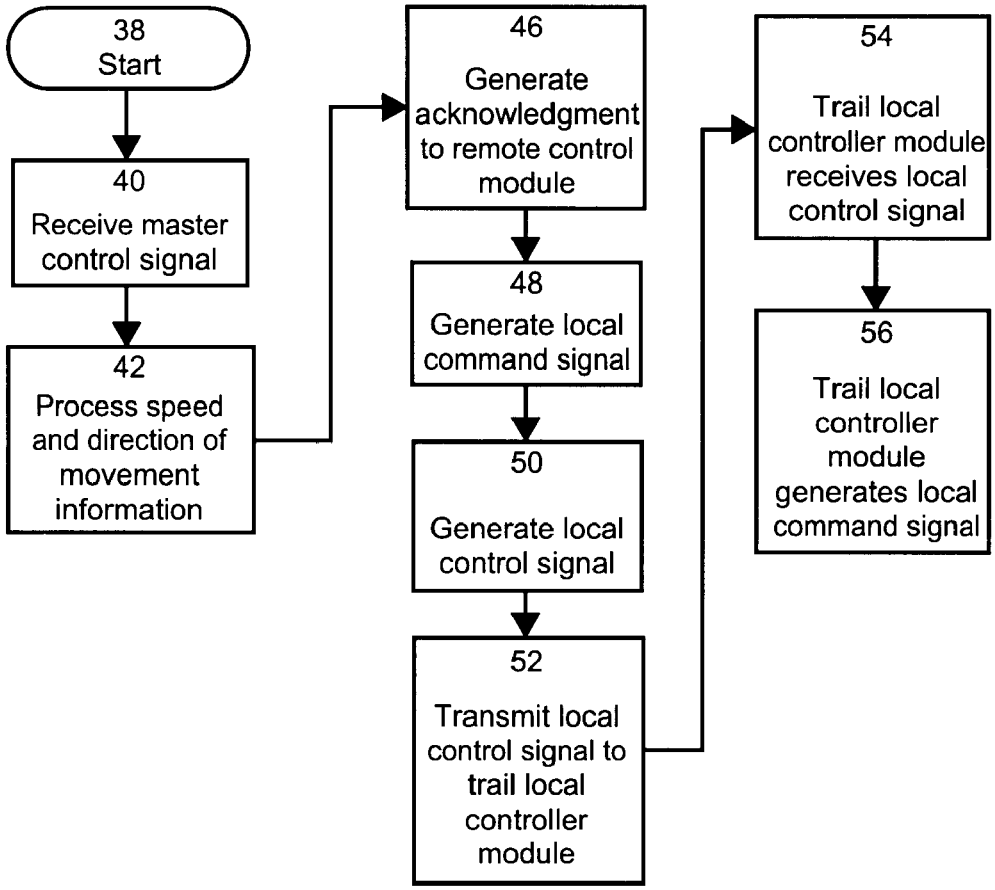
FIGS. 5*a* and 5*b* depict flowcharts illustrating the operation of the remote control system for a locomotive according to a non-limiting example of implementation of the present invention.
Figure 5B:
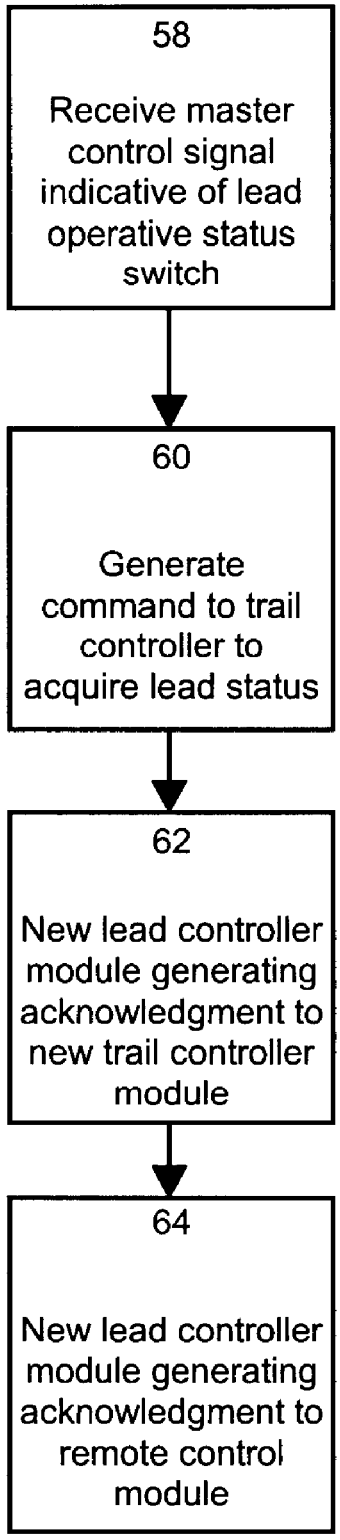

The operation of the remote control system will now be described in greater detail with reference to the flowcharts appearing in FIGS. 5*a* and 5*b*. The process starts at step 38 in FIG. 5*a*. As described earlier, the operator sets the various controls on the control panel 30 as desired and the remote control module 24 issues the master control signal. As discussed earlier, the master control signal includes an address portion that uniquely identifies the controller module 18 to whom the master control signal is destined. In a specific example, the various controller modules are assigned respective addresses that are hardwired and that cannot be easily changed. This avoids a situation where two controller modules may be assigned by mistake the same address which may create a hazardous condition if. both controller modules come within the communication range of the remote control module 24. It is to be noted however that other methods of assigning addresses may be used such as storing the address on a programmable memory (ROM, PROM, EPROM and so on) without detracting from the spirit of the invention.

At step 40, the controller module 18 receives the master control signal. Assume for the sake of this example that the controller module 18 to whom the master control signal is addressed is installed in the locomotive 10. Note that the controller module 18 that is installed in the locomotive 16 will also receive the signal, however it will ignore it since the address portion in the signal will not match the local address. The controller module 18 in the locomotive 10 processes the master control signal and extracts the instructions contained therein.

At step 46, the controller module 18 sends a signal to the remote control module acknowledging reception of the master control signal. Optionally, the remote control module may, upon reception of the acknowledgment signal visually indicate to the operator that the controller module 18 in the locomotive 10 has confirmed reception of the command. It is to be noted that step 46 is essentially a method of confirming the reception of an instruction and may be omitted without detracting from the spirit of the invention.

At step 48, in a second form of implementation where the master control signal includes a desired speed, the processing unit 22 will compute appropriate throttle and brake settings and generate a local command signal that, as described earlier, includes a throttle setting information and brake setting information among others. The local command signal is issued through the input/output 23 and applied to the locomotive controls as briefly described earlier.

At step 48, in a second form of implementation where the master control signal includes a throttle and brake setting, the processing unit 22 will generate a local command signal that, as described earlier, includes a throttle setting information and a brake setting information among others. The local command signal is issued through the input/output 23 and applied to the locomotive controls as briefly described earlier.

The processing unit 22 will also derive a throttle setting information and a brake setting information for the other locomotive (locomotive 16). In a specific example of implementation, the brake settings for both locomotives 10, 16 are identical. The throttle settings for the locomotives 10, 16 are also essentially identical. Alternatively, the processing unit 22 can compute the throttle settings and brake settings for the locomotives 10, 16 such as to introduce delays in application of the commands between the locomotives 10, 16 or any other differences.

At step 50, the processing unit 22 inserts the throttle setting information and the brake setting information for the locomotive 16 into a packet and transmits this packet over an RF link between the two controller modules 18. The RF link is established between the communication units 20 of the controller modules 18. It is preferred that the inter controller module communication be effected over a different communication channel than the communication between a controller module 18 and the remote control module 24. Each channel may be assigned a different frequency band. Alternatively, the same frequency band can be used but the channels are multiplexed by using a time division multiplexing and code division multiplexing, among others. Yet another possibility is to use a single communication channel, and provide in each data packet sent a flag that indicates whether the packet is for inter controller module communication or for communication between a controller module 18 and the remote control module 24. Yet another possibility is to use a single communication channel, and provide in each data packet sent an address that indicates to whom the packet is directed.

At step 50, the controller module 18 in the locomotive 10 sends to the controller module 18 in the locomotive 16 the local control signal. The data packet in the local control signal includes in the header portion the address of the controller module 18 in the locomotive 16 to ensure that this command will not be received by any other entity. At step 54 the controller module 18 in the locomotive 16 receives the local control signal. The controller module 18 in the locomotive 16 acts as a trail and simply implements the throttle setting and the brake setting (among other possible settings) computed by the controller module 18 in the locomotive 10. The implementation is materialized by the generation of the local command signal that is applied to the controls of the locomotive 16.

As a result of the above-described process, the train is caused to move in the desired direction and the desired throttle/brake setting is applied. If any change is necessary, the operator alters the settings at the remote control module 24 and the above-described process is repeated.

As a variant, a master control signal is transmitted from the remote control module to the lead controller module at every control cycle. If a master control signal is not received within a certain number of control cycles, the lead controller module assumes that an error has occurred and the train is stopped. The control cycle is typically several times per second but may vary depending on the train on which the system is mounted.

In another example of a typical interaction, the remote control module 24 generates a master control signal indicative of a switch in the lead operational status. This interaction is depicted in figure Sb. At step 58, the controller module having the lead operational status receives the master control signal indicative of a switch in the lead operational status. At step 60, the controller module 18 in the locomotive 10 having the lead operational status relinquishes the lead operational status to the controller module 18 in the locomotive 16 having the trail operational status. The status of a controller module 18, whether lead or trail can be identified by the value of a flag in the memory 36 of the processing unit 22. For instance, if the flag is set this means that the controller module 18 holds the lead operational status. Otherwise, the controller module holds the trail operational status. A status switch is effected by exchanging messages between the controller modules 18 over the RF link. In particular, as indicated at step 60, the controller module 18 in the locomotive 10 generates and sends over the RF link a command to the controller module 18 in the locomotive 16 to set its status flag (acquire lead operational status). At step 62 the controller module 18 in the locomotive 16 sends an acknowledgment to the controller module 18 in the locomotive 10 that confirms the acquisition of the lead operational status. At this point, the controller module 18 in the locomotive 10 clears its status flag such as to acquire the trail operational status.

Optionally, at step 64 the controller module 18 in the locomotive 16 sends a control message to the remote control module 24 to indicate that it has acquired the lead operational status. In response to this control message the remote control module 24 will replace in a register implemented in the processing unit 28 the address of the controller module 18 in the locomotive 10 by the address of the controller module 18 in the locomotive 16. Accordingly, any further communication originating from the remote control module 24 will be directed to the controller module 18 in the locomotive 16. Alternatively, the address of the controller module 18 in the locomotive 10 may be replaced by the address of the controller module 18 in the locomotive 16 prior to the remote control module sending the master control signal indicative of a status switch. In this alternative example, step 64 may be omitted.

Figure 5C:
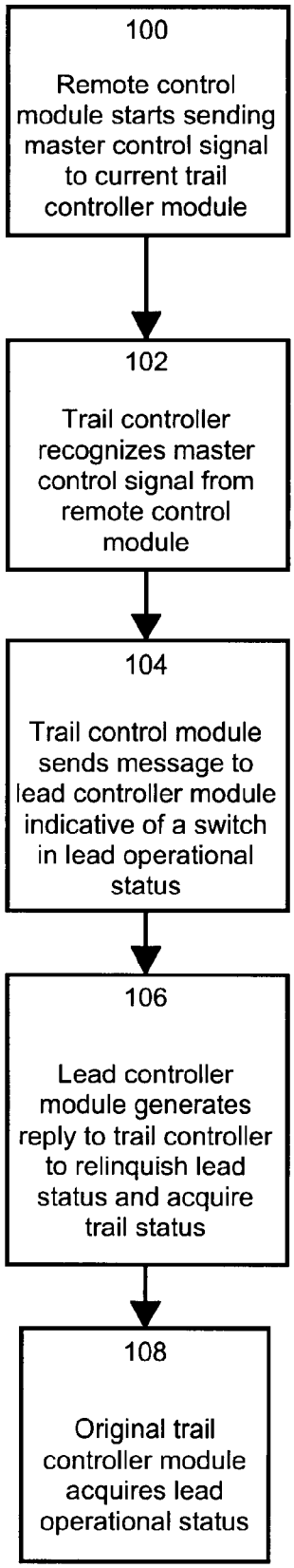

As a variant, the remote control module 24 initiates a switch in the lead operational status by redirecting the transmission of the master control signal from the current lead controller module to the current trail controller module. This interaction is depicted in FIG. 5*c*. At step 102, the controller module having the trail operational status receives the master control signal. At step 104, the current trail controller module sends a message over the RF link to the current lead controller module indicative of a switch in lead operational status. A step 106, the current lead controller module, no longer receiving message from the remote control module and receiving the message sent at step 104, relinquishes the lead operational status and acquires the trail operational status. At step 108, the original trail controller module acquires the lead operational status. Preferably, during the status switch process, the train on which are mounted the first controller module and the second controller module is stationary.

As described above, the controller modules 18 and the remote control module 24 communicate with one another through radio frequency links by placing in a header portion of messages data elements indicative of addresses. These addresses, also referred to as identifiers, allow to uniquely identify each of the components of the communication system. The address of a component is communicated to the other component during an initialization phase. The system initialization will now be described with reference to FIGS. 6*a*, 6*b*, 6*c* and 6*d*.

The locomotive control system considered in this specific example is a remote control system that comprises three components, namely: a remote control module 604, a first controller module 600, and a second controller module 602.

Figure 6A:
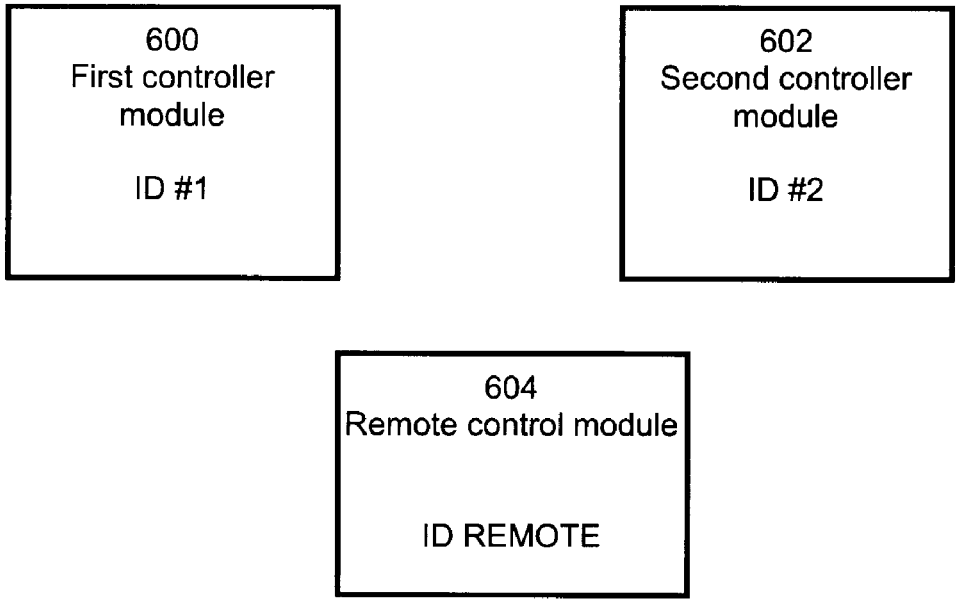
FIGS. 6*a*, 6*b*, 6*c* and 6*d* depict functional block diagrams of a system for remotely controlling a train in accordance with an alternative aspect of the invention.

In FIG. 6*a*, the components are shown prior to any address exchange. Each component is associated to a respective address and stores this address in a memory location. For instance, the first controller module 600 is associated to ID#1, the second controller module 602 to ID #2 and the remote control module 604 to ID REMOTE. ID#1, ID#2 and ID REMOTE are alphanumeric strings allowing to distinguish the various components.

Figure 6B:
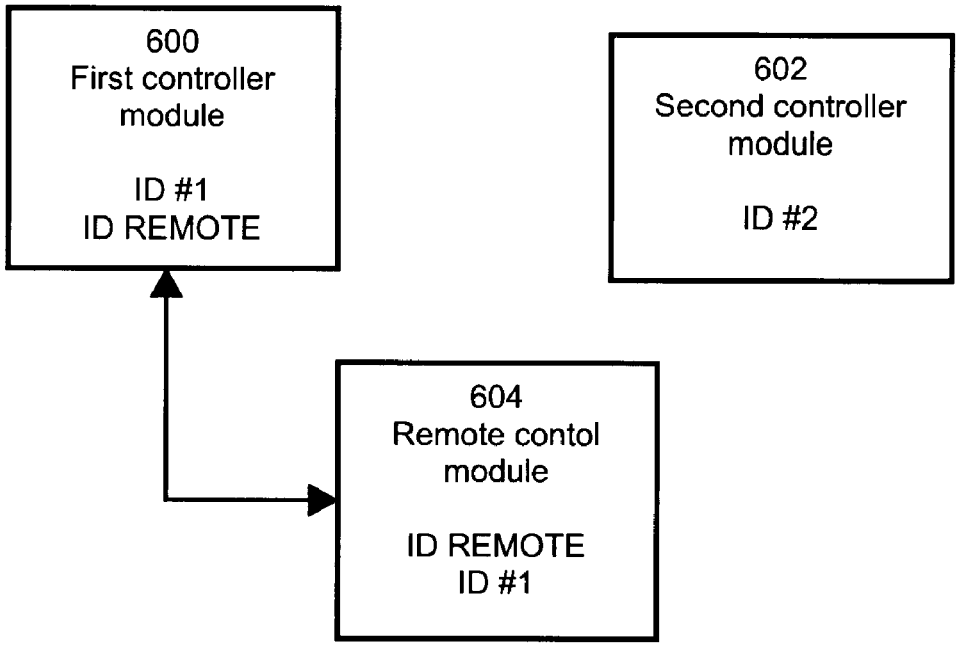

In FIG. 6*b*, the remote control module 604 establishes a first proximity data exchange transaction with the first controller module 600 allowing the first controller module 600 to received the address of the remote control module 604 (ID REMOTE) and for the remote control module 604 to receive the address of the first controller module 600 (ID #1). At the end of the transaction, the remote control module 604 and the first controller module 600 store ID REMOTE and ID#1. In a specific example of implementation, the first proximity data exchange transaction is effected over an infrared (IR) link. Alternative, the first proximity data exchange transaction is effected over a link selected from the set consisting of an infra red link, a coaxial cable link, a wire link and an optical cable link.

Figure 6C:
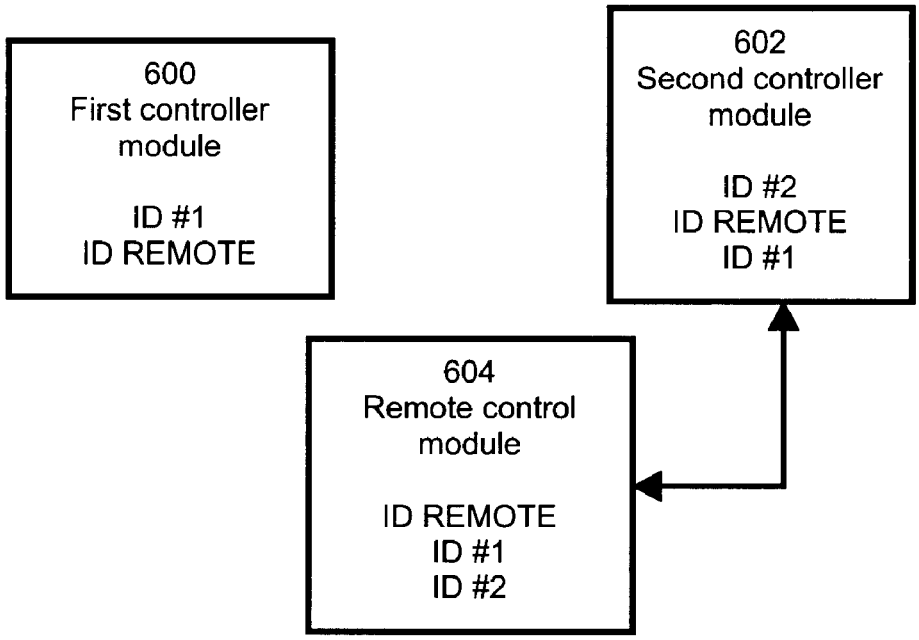

In FIG. 6*c*, the remote control module 604 establishes a second proximity data exchange transaction with the second controller module 602 allowing the second controller module to receive the address of the remote control module 604 (ID REMOTE), the address of the first controller module 600 (ID#1) and for the remote control module 604 to received the address of the second controller module 602 (ID #2). At the end of the transaction, the remote control module 604 and the second controller module 602 store ID REMOTE, ID#1 and ID#2. In a specific example of implementation, the second proximity data exchange transaction is effected over an infrared (IR) link. Alternatively, the second proximity data exchange transaction is effected over a link selected from the set consisting of an infra red link, a coaxial cable link, a wire link and an optical cable link.

Figure 6D:
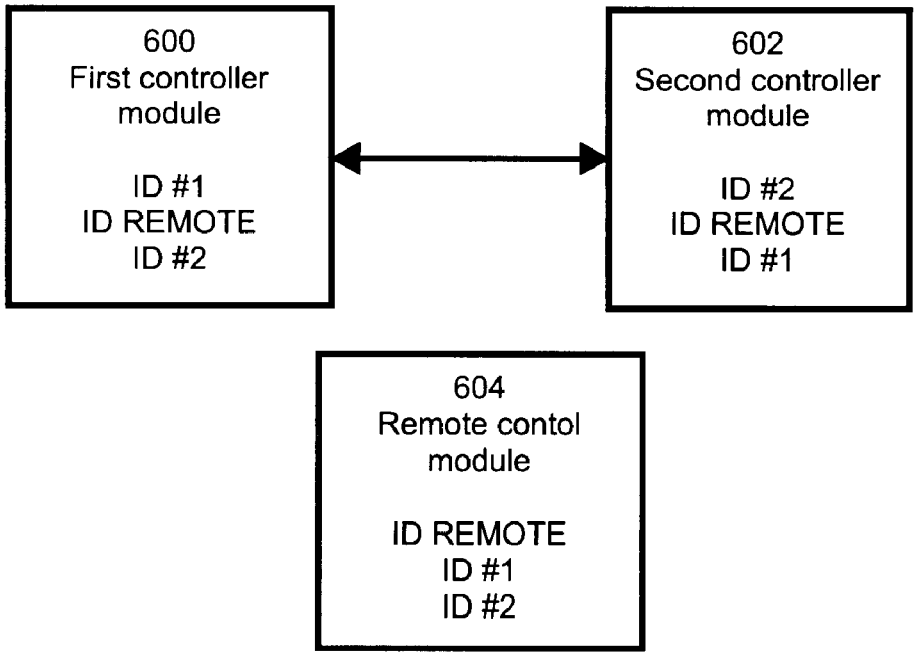

In FIG. 6*d*, the second controller module 602 establishes a non-proximity communication link with the first controller module 600 allowing the first controller module 600 to received the address of the second controller module 602 (ID#2). At the end of the transaction, all components store ID REMOTE, ID#1 and ID#2. In a specific example of implementation, the non-proximity communication link is a radio frequency (RF) link.

Each component 600, 602, 604 stores the addresses of the other component in a memory unit for use when transmitting messages. Once each component has the address of the other components in the remote control system, the remote control module 604 communicates over an RF channel with either the first controller module or the second controller module to assign the lead operational status. Once the lead operational status has been assigned, the controller module having the lead operational status communicates over a RF channel with the other controller module to assign to it a trail operational status.

The functional elements of the process described earlier are implemented in software that is in the form of program elements executed in the processing units 22, 28 in the controller modules 18 and in the remote control module 24.

Although various embodiments have been illustrated, this was for the purpose of describing, but not limiting, the invention. Various modifications will become apparent to those skilled in the art and are within the scope of this invention, which is defined more particularly by the attached claims.

We claim:

1. A system for remotely controlling a train having a first locomotive and a second locomotive separated from one another by at least one car, said system comprising:

a) a first controller module for mounting in the first locomotive;

b) a second controller module for mounting in the second locomotive;

c) a remote control module;

d) each of said modules having a machine readable storage medium for storage of an identifier, the identifier allowing to distinguish said modules from one another;

e) each module being operative to transmit messages to another one of said modules over an RF communication link, a message sent by any one of said modules over the RF communication link being sensed by each of the other ones of said modules, each message including an address portion for holding the identifier of the module to which the message is directed;

f) said remote control module and said first controller module being operative to engage in a first data exchange transaction over a communication link other than the RF communication link such that said remote control module acquires and stores in the machine readable storage medium of said remote control module the identifier of said first controller module and said first controller module acquires and stores in the machine readable storage medium of said first controller module the identifier of said remote control module;

g) said remote control module and said second controller module being operative to engage in a second data exchange transaction over a communication link other than the RF communication link such that said remote control module acquires and stores in the machine readable storage medium of said remote control module the identifier of said second controller module and said second controller module acquires and stores in the machine readable storage medium of said second controller module the identifier of said remote control module and the identifier of said first controller module;

h) said first controller module and said second controller module being operative to engage in a third data exchange transaction over the RF communication link such that said first controller module acquires and stores in the machine readable storage medium of said first controller module the identifier of said second controller module.

2. A system as defined in claim 1, wherein said first data exchange transaction is effected over an infra red communication link.

3. A system as defined in claim 1, wherein said second data exchange transaction is effected over an infra red communication link.

4. A system as defined in claim 1, wherein said first data exchange transaction is effected over a communication link selected from the set consisting of an infra red communication link, a coaxial cable communication link and an optical cable communication link.

5. A method for initializing a remote control system for a train having a first locomotive and a second locomotive separated from one another by at least one car, said remote control system including:

a) a first controller module for mounting in the first locomotive;

b) a second controller module for mounting in the second locomotive;

c) a remote control module each of the first controller module, the second controller module and the remote control module having a machine readable storage medium for storage of respective identifiers, the identifiers allowing to distinguish the first controller module, the second controller module and the remote controller module from one another, said method including:

i. establishing a first data exchange transaction between the remote control module and the first controller module such that the remote control module acquires and stores in the machine readable storage medium of the remote control module the identifier of the first controller module and the first controller module acquires and stores in the machine readable storage medium of the first controller module the identifier of the remote control module;

ii. establishing a second data exchange transaction between the remote control module and the second controller module such that the remote control module acquires and stores in the machine readable storage medium of the remote control module the identifier of the second controller module and the second controller module acquires and stores in the machine readable storage medium of the second controller module the identifier of the remote control module and the identifier of the first controller module;

iii. establishing a third data exchange transaction between the first controller module and the second controller module such that the first controller module acquires and stores in the machine readable storage medium of the first controller module the identifier of the second controller module, the third data exchange transaction being effected over an RF communication link;

iv. the first data exchange transactions being effected over a communication link other than the RF communication link;

v. the second data exchange transaction being effected over a communication link other than the RF communication link.

6. A method as defined in claim 5, wherein the first data exchange transaction is effected over a communication link selected in the group consisting of IR communication link, coaxial cable communication link and optical cable communication link.

7. A method as defined in claim 5, wherein the second data exchange transaction is effected over a communication link selected in the group consisting of IR communication link, coaxial cable communication link and optical cable communication link.

8. A method as defined in claim 5, wherein said second data exchange transaction is effected over an infra red communication link.

9. A method as defined in claim 5, wherein said first data exchange transaction is effected over an infra red communication link.

10. A method as defined in claim 5, wherein the remote control module is portable.

11. A system for remotely controlling a train having a first locomotive and a second locomotive separated from one another by at least one car, the system including:

a) a first controller module for mounting in the first locomotive, the first controller module having a lead operational status;

b) a second controller module for mounting in the second locomotive, the second controller module having a trail operational status;

c) a remote control module operative to issue a master control signal to the first controller module indicative of a switch in the lead operational status;

d) wherein the first controller module is operative to:

i. receive the master control signal issued from the remote control module; and ii. forward to the second controller module, over an RF communication link, a local command signal instructing the second controller module to acquire the lead operational status;

e) said second controller module being responsive to said local command to relinquish the trail operational status and to acquire the lead operational status;

f) in response to the second controller module acquiring the lead operational status, said first controller module relinquishing the lead operational status and acquiring the trail operational status.

12. A system as defined in claim 11, wherein the second controller module transmits to the first controller module an acknowledgement signal confirming that the second controller module has acquired the lead operational status.

13. A system as defined in claim 12, wherein the second controller module is operative to transmit to the remote control module a control signal indicating that the second controller module has acquired the lead operational status.

14. A system as defined in claim 11, wherein the master control signal is transmitted over a wireless communication link.

15. A system as defined in claim 14, wherein the master control signal is transmitted over an RF communication link.

16. A system as defined in claim 14, wherein the remote control module is further operative to issue a master control signal carrying information about the desired direction of the train to either one of the first and second controller modules which has the lead operational status.

17. A system as defined in claim 16, wherein the master control signal carries information about a desired speed of the train.

18. A system as defined in claim 14, wherein the master control signal carries information about a throttle setting to apply.

19. A system as defined in claim 14, wherein the master control signal carries information about a brake setting to apply.

20. A system as defined in claim 11, wherein the master control signal includes an address information that identifies the controller module having the lead operational status.

21. A system as defined in claim 11, wherein the first controller module and the second controller module each include a communication unit comprising a receiver unit and a transmitter unit.

22. A system as defined in claim 11, wherein each controller module includes a processing unit coupled to said communication unit.

23. A system as defined in claim 11, wherein the remote control module is portable.

24. A method for controlling a train using a remote control system, the train having a first locomotive and a second locomotive separated from one another by at least one car, the remote control system including:

a) a remote control module operative to transmit a master control signal;

b) a first controller module for mounting in the first locomotive, the first controller module having a lead operational status;

c) a second controller module for mounting in a second locomotive, the second controller module having a trail operational status;

said method comprising:

receiving at the first controller module a master control signal, the master control signal being indicative of a switch in the lead operational status;

forwarding from the first controller module to the second controller module, over an RF communication link, a local command signal instructing the second controller module to acquire the lead operational status, thereby causing the second controller module to relinquish the trail operational status and acquire the lead operational status;

in response to the second controller module acquiring the lead operational status, relinquishing at the first controller module the lead operational status and acquiring the trail operational status.

25. A method as defined in claim 24, said method further comprising transmitting from the second controller module to the first controller module an acknowledgement signal confirming that the second controller module has acquired the lead operational status.

26. A method as defined in claim 25, said method further comprising transmitting from the second controller module to the remote control module a control signal indicating that the second controller module has acquired the lead operational status.

27. A method as defined in claim 25, wherein the master control signal is transmitted over a wireless communication link.

28. A method as defined in claim 27, wherein the master control signal is transmitted over an RF communication link.

29. A method as defined in claim 27, wherein the remote control module is further operative to issue a master control signal carrying information about the desired direction of the train.

30. A method as defined in claim 27, wherein the remote control module is further operative to issue a master control signal carrying information about a desired speed of the train in a desired direction.

31. A method as defined in claim 27, wherein the remote control module is further operative to issue a master control signal carrying information about a throttle setting to apply.

32. A method as defined in claim 27, wherein the remote control module is further operative to issue a master control signal carrying information about a brake setting to apply.

33. A method as defined in claim 27, wherein the master control signal includes an address information that identifies the controller module having the lead operational status.

34. A method as defined in claim 27, wherein the first controller module and the second controller module each include a communication unit comprising a receiver unit and a transmitter unit.

35. A method as defined in claim 27, wherein each controller module includes a processing unit coupled to said communication unit.

36. A method as defined in claim 27, wherein the remote control module is portable.

37. A system for remotely controlling a train having a first locomotive and a second locomotive separated from one another by at least one car, the system including:

a) a first controller module for mounting in the first locomotive, the first controller module having a lead operational status;

b) a second controller module for mounting in the second locomotive, the second controller module having a trail operational status;

c) a remote control module operative to issue a master control signal to said first controller module for signaling the train to move in a desired direction;

wherein the remote control module is operative to initiate a switch in operational status between the first controller module and the second controller module by redirecting the master control signal to the second controller module, in response to said master control signal said second controller module being operative for:

forwarding to the first controller module, over an RF communication link, a local command signal indicative of a switch in operational status, thereby causing the first controller module to relinquish the lead operational status and to acquire the trail operational status;

relinquishing the trail operational status and acquiring the lead operational status.

38. A system as defined in claim 37, wherein the master control signal is transmitted over a wireless communication link.

39. A system as defined in claim 38, wherein the master control signal is transmitted over an RF communication link.

40. A system as defined in claim 39, wherein master control signal carries information about the desired direction of the train to a controller module having the lead operational status.

41. A system as defined in claim 40, wherein the master control signal carries information about a desired speed of the train in the desired direction.

42. A system as defined in claim 39, wherein the master control signal carries information about a throttle setting to apply.

43. A system as defined in claim 39, wherein the master control signal carries information about a brake setting to apply.

44. A system as defined in claim 37, wherein the first controller module and the second controller module each include a communication unit comprising a receiver unit and a transmitter unit.

45. A system as defined in claim 44, wherein each controller module includes a processing unit coupled to said communication unit.

46. A system as defined in claim 37, wherein the remote control module is portable.

47. A method for controlling a train using a remote control system, the train having a first locomotive and a second locomotive separated from one another by at least one car, the remote control system including:

a) a remote control module operative to transmit a master control signal;

b) a first controller module for mounting in the first locomotive, the first controller module having a lead operational status;

c) a second controller module for mounting in the second locomotive, the second controller module having a trail operational status;

said method comprising:

receiving at the second controller module a master control signal originating from the remote control module;

forwarding from the second controller module to the first controller module, over an RF communication link a local command signal indicative of a switch in operational status, thereby causing the first controller module to relinquish the lead operational status and to acquire the trail operational status;

at the second controller module, relinquishing the trail operational status and acquiring the lead operational status.

48. A method as defined in claim 47, wherein the master control signal is transmitted over a wireless link.

49. A system as defined in claim 48, wherein the master control signal is transmitted over an RF communication link.

50. A system as defined in claim 49, wherein the remote control module is further operative to issue a master control signal carrying information about the desired direction of the train to a controller module having the lead operational status.

51. A system as defined in claim 50, wherein the remote control module is further operative to issue a master control signal carrying information about a desired speed of the train in the desired direction.

52. A system as defined in claim 49, wherein the remote control module is further operative to issue a master control signal carrying information about a throttle setting to apply.

53. A system as defined in claim 49, wherein the remote control module is further operative to issue a master control signal carrying information about a brake setting to apply.

54. A system as defined in claim 47, wherein the first controller module and the second controller module each include a communication unit comprising a receiver unit and a transmitter unit.

55. A system as defined in claim 54, wherein each controller module includes a processing unit coupled to said communication unit.

56. A system as defined in claim 47, wherein the remote control module is portable.

57. A remote control unit for remotely controlling a train having a first locomotive and a second locomotive separated from one another by at least one car, the first locomotive being associated with a first controller module having a machine readable storage medium for storage of an identifier, the second locomotive being associated with a second controller module having a machine readable storage medium for storage of an identifier, the identifiers allowing to distinguish the first controller module and the second controller module from one another, said remote control unit comprising:

a) a machine readable storage medium for storage of a remote unit identifier, the remote unit identifier allowing to distinguish the remote control unit from the first and second controller modules;

b) said remote control module being operative to engage in a first data exchange transaction with the first controller module to:

acquire and store in the machine readable storage medium of said remote control module the identifier of the first controller module;

transmit to the first controller module the remote control unit identifier;

c) said remote control module being operative to engage in a second data exchange transaction with the second controller module to:

acquire and store in the machine readable storage medium of said remote control module the identifier of said second controller module;

transmit to the second controller module the remote control unit identifier and the identifier of the first controller module;

d) said remote control unit being operative to each module being operative to transmit messages to either one of the first and second controller modules an RF communication link, each message including an address portion for holding the identifier of the controller module to which the message is directed.

58. A remote control unit as defined in claim 57, wherein said first data exchange transaction is effected over an infra red communication link.

59. A remote control unit as defined in claim 57, wherein said second data exchange transaction is effected over an infra red communication link.

60. A remote control unit as defined in claim 57, wherein said first proximity data exchange transaction is effected over a communication link selected from the set consisting of an infra red communication link, a coaxial cable communication link and an optical cable communication link.

61. A remote control unit as defined in claim 57, wherein the remote control module is portable.

* * * * *